US005310605A

United States Patent [19]

Baldoni, II et al.

[11] Patent Number: 5,310,605

[45] Date of Patent: May 10, 1994

[54] SURFACE-TOUGHENED CEMENTED CARBIDE BODIES AND METHOD OF MANUFACTURE

[75] Inventors: J. Gary Baldoni, II, Norfolk, Mass.; Stephen L. Bennett, Rochester Hills, Mich.

[73] Assignee: Valenite Inc.

[21] Appl. No.: 935,487

[22] Filed: Aug. 25, 1992

[51] Int. Cl.[5] ..... B22F 3/10

[52] U.S. Cl. ..... 428/569; 428/546; 419/38; 419/10; 419/14; 419/15; 419/16; 419/25

[58] Field of Search ..... 29/182.7; 75/176, 239; 82/1; 148/166; 175/57; 428/457, 547, 565, 698

[56] References Cited

U.S. PATENT DOCUMENTS

| | | | |
|---|---|---|---|
| Re. 32,111 | 4/1986 | Lambert et al. | 428/212 |
| Re. 34,180 | 2/1993 | Nemeth et al. | 428/547 |
| 3,999,953 | 12/1976 | Kolaska et al. | 29/182.7 |
| 3,999,954 | 12/1976 | Kolaska et al. | 29/182.7 |
| 4,150,195 | 4/1979 | Tobioka et al. | 428/458 |
| 4,277,283 | 7/1981 | Tobioka et al. | 75/238 |
| 4,497,874 | 2/1985 | Hale | 428/551 |
| 4,548,786 | 10/1985 | Yohe | 419/29 |
| 4,610,931 | 9/1986 | Nemeth et al. | 428/547 |
| 4,830,930 | 5/1989 | Taniguchi et al. | 428/547 |
| 4,911,989 | 3/1990 | Minoru et al. | 428/547 |

FOREIGN PATENT DOCUMENTS 2-197569 8/1990 Japan .

OTHER PUBLICATIONS

ASTM Designation: B 276-86, "Standard Test Method for Apparent Porosity in Cemented Carbides," American Society for Testing and Materials, Philadelphia, Pa.

B. J. Nemeth et al., "The Microstructural Features . . . of the High Edge Strength Kennametal Grade KC850," *Proc. 10th Plansee Seminar,* 1, Reutte/Tyrol, pp. 613-627 (1981).

G. P. Grab et al., "An Advanced Cobalt-Enriched Grade Designed to Enhance Machining Productivity," *High Prod. Machining,* V. K. Sarin, Ed., ASM (1985) pp. 113-120.

H. Suzuki et al., "The β-Free Layer Formed near the Surface of Vacuum-Sintered WC-β-Co Alloys Containing Nitrogen," *Trans. J. Inst. Met.,* 22 [11] 758-764 (1981).

H. Tsukada et al., "The Development of a Nitrogen-Contained Cemented Carbide and the Cutting Performance of the Grade A30N . . . ," *Sumitomo Elec. Technol. Rev.,* No. 24 (Jan. 1985).

A. Doi et al., "Thermodynamic Evaluation of Equilibrium Nitrogen Pressure and WC Separation in Ti-W--C-N System Carbonitride," *Proc. 11th Plansee Conf., HM8,* pp. 825-843 (1985).

M. Schwarzkopf et al., "Kinetics of Compositional Modification of (W,Ti)C-WC-Co Alloy Surfaces," *Mat. Sci. Eng.,* A105/106 (1988) 225-231.

*Primary Examiner*—Donald P. Walsh
*Assistant Examiner*—John N. Greaves
*Attorney, Agent, or Firm*—Bill C. Panagos

[57] ABSTRACT

A process for producing a ceramic-metal composite body exhibiting binder enrichment and improved fracture toughness at its surface. The process involves forming a shaped body from a homogeneous mixture of: (a) about 2-15 w/o Co or about 2-12 w/o Ni binder, (b) excess carbon, (c) optionally, 0 to less than 5.0 v/o B-1 carbides, and (d) remainder tungsten carbide. The mixture contains sufficient total carbon to result in an ASTM carbon porosity rating of C06 to C08 at the core of the densified body. The weight ratio of excess carbon to binder is about 0.05:1 to 0.037:1. The shaped body is densified in a vacuum or inert atmosphere at or above about 1300° C. and slow cooled, at least to about 25° below the eutectic temperature. Alternatively, the sintered body may be cooled to a holding temperature at or slightly above the eutectic temperature, isothermally held for at least ½ hr, and further cooled to ambient. The core zone of the resulting densified body exhibits an ASTM carbon porosity rating of about C02-C08, while its surface zone exhibits an ASTM carbon porosity rating of about C00. The surface zone has an outer surface layer enriched in binder content to a depth of about 5-200 μm, improving the surface fracture toughness of the body. Sintering temperature and pressure may be tailored to produce efficiently either a tool suitable for coating or a tool suitable for brazing.

24 Claims, 3 Drawing Sheets

SURFACE-TOUGHENED CEMENTED CARBIDE BODIES AND METHOD OF MANUFACTURE

BACKGROUND OF THE INVENTION

This invention relates to cemented carbide materials, and in particular to bodies fabricated of metal-cemented carbide materials in which the fracture toughness of the body surface has been increased by enrichment of the metal binder component in that region. The invention also relates to a method for manufacturing such surface-toughened bodies.

In the cemented carbide tool industry, high toughness is generally achieved with straight WC-Co grades, which are fully dense composites of tungsten carbide grains and a metal, typically cobalt, binder. Improved chemical wear resistance and high deformation resistance are addressed with multi-carbide steel cutting grades, for example WC-Co composites containing at least 10 w/o (weight percent) $\beta$-phase. The so-called $\beta$-phase materials are carbides having a "rock-salt" crystal structure, and are generally called B-1 carbides in the cutting tool industry. These are the carbides of titanium, zirconium, hafnium, vanadium, niobium, and tantalum. The most common B-1 carbides used in the cutting tool industry are TiC, TaC, and NbC.

The application of hard refractory coatings, for example TiC or dual layer coatings of $TiC/Al_2O_3$, to cutting tools, generally by chemical vapor deposition (CVD), has been used to improve the wear resistance of the tools. The application of hard refractory coatings to cemented carbide cutting tool substrates greatly reduces the effect of many of the wear processes, for example chemical/diffusion wear, which are of concern when dealing with uncoated cutting tool grades. This frees the tool manufacturer to tailor the substrate microstructure to achieve both high toughness and high deformation resistance.

The application of a refractory coating, however, can itself significantly reduce the toughness of a carbide tool, for example reducing the chipping or breakage resistance of the tool by as much as 20–50%. Accordingly, considerable effort has been directed to development of substrates with even further increased toughness to offset the toughness decreasing effects of the coating process. Such high toughness along with high deformation resistance may be achieved by surface toughening of a substrate having a deformation-resistant core.

In one type of surface toughening process a B-1 carbide containing substrate, for example a WC-Co substrate containing about 10 w/o total TiC and TaC, is treated to cause removal of the B-1 carbides from the substrate surface by migration of these carbides toward the core of the tool. During this treatment, binder, in turn, migrates toward the surface. Thus a near-surface layer is produced, typically 20–50 microns in depth, having a microstructure devoid of B-1 carbides and enriched in binder content (about twice that of the bulk). This layer devoid of B-1 carbides is called a $\beta$-free layer ($\beta$FL). The binder enrichment in this layer results in a tool exhibiting high toughness.

Another type of surface toughening process for B-1 carbide containing substrates is effected in the presence of so-called "C-porosity". The term "C-porosity" refers to free carbon present in the microstructure. This free carbon is excess carbon, that is an amount beyond the solubility limit of carbon in the binder, precipitated from the liquid phase during cooling from the high sintering temperature. Such C-porosity is described in further detail in ASTM B 276-86, incorporated herein by reference. This C-porosity is known to be present in tungsten carbide-cobalt substrates containing about 10 w/o B-1 carbides, and has been shown to produce heavy binder enrichment (about three times that of the bulk) in the surface layers of such substrates during sintering. The presence of B-1 carbides has thus been considered necessary for such binder enrichment by those skilled in the art.

The microstructure of these surface binder-enriched substrates exhibits a binder content which decreases gradually with the depth from the surface until it reaches the bulk value. In the region of increased binder content, the article exhibits a stratified microstructure with the metal binder appearing as "wavelets" in the binder-enriched zone. The enriched zone contains some B-1 carbides, but their concentration decreases gradually from the bulk value to essentially zero at the surface.

The increase in binder content in the surface layer increases the resistance to fracture of the outer substrate layer, (a) inhibiting propagation into the substrate of cracks inherent in brittle refractory coatings applied to the substrate surface, and (b) increasing the impact resistance of the coated tool. Since the toughened surface layer below the coating is thin, the properties inherent in the microstructure of the bulk of the substrate predominate, and the required deformation resistance is maintained.

As mentioned above, it has been generally accepted by those skilled in the art that such binder-enriched surface layers may be achieved only in the presence of B-1 carbides, whether by creation of a $\beta$-free layer or in the presence of C-porosity.

U.S. Pat. No. 4,277,283 (Tobioka et al.) describes $\beta$FL layers produced by adding 4–6.3 w/o solid solution carbonitride, $(Ti_{.75}W_{.25})(C_{.68}N_{.32})$, to a mixture of (Ta.75Nb.25)C, cobalt, and WC. This produced a $\beta$FL surface layer devoid of B-1 transition metal carbonitride phase. Other compositions containing only WC and solid solution carbonitride with cobalt produced a $\beta$FL layer, but these all contained at least 10 w/o B-1 carbonitride.

U.S. Pat. No. 4,558,786 (Yohe) describes surface toughening of cobalt bonded tungsten titanium carbide substrates containing TaC and (W,Ti)C by B-1 phase depletion and binder enrichment.

U.S Pat. No. 4,497,874 (Hale) also describes binder enrichment surface toughening in a composition of TiC (or (W,Ti)C), TaC, cobalt, and WC.

U.S. Pat. No. 4,610,931 (Nemeth et al.) describes binder-enriched surfaces in cemented carbides containing Co, a chemical agent, B-1 carbides or solid solution carbides, and WC. The chemical agent is a transition metal or solid solution, or their hydride, nitride, or carbonitride which is at least partially converted to the metal carbide on sintering. Free carbon may be added to convert added metals, hydrides, nitrides, or carbonitrides to B-1 carbides.

U.S. Pat. No. 4,150,195 (Tobioka et al.) describes adding excess carbon to cemented carbide substrates to increase toughness. No binder enrichment is described.

Nemeth et al. (10th Plansee Seminar Proc., 1, p. 613, 1981) describe a B-1 containing cemented carbide cutting tool having a substrate partially surface-toughened through binder enrichment.

Grab et al. (*High Productivity Machining*, ed. V. K. Sarin, ASM, p. 113, 1985) discuss binder-enriched, surface-toughened substrates of a composition similar to that described by Nemeth et al., referenced immediately above.

Suzuki (*Trans. Japan Inst. of Metals*, 22 (11) pp. 758–764, 1981) describe cemented carbides exhibiting a βFL layer and including B-1 solid solution carbonitrides. Similar materials are reported by Tsukado et al. (*Sumitomo Electric Tech. Rev.* #24, Jan. 1985).

All of these references describe cemented carbides which are surface toughened by binder enrichment and βFL formation, which is the creation of a surface layer devoid of B-1 carbide phase. The described cemented carbides all contain Co, WC, and appreciable amounts of B-1 carbides. The amounts of carbides, etc. are expressed in weight percent in these references. Since the density of TiC is about 5 g/cm$^3$, that of TaC is about 15 g/cm$^3$, and that of WC is about 15 g/cm$^3$, the TiC-containing formulations in these references are particularly high in volume percent of B-1 carbides. This limits the opportunity for achieving the advantages of surface toughening to only those compositions containing sufficient B-1 phase such that B-1 phase migration may be effected and a βFL developed. It would be advantageous to develop other cemented carbide compositions, for example B-1 carbide free compositions, in which surface binder-enrichment may be produced.

SUMMARY OF THE INVENTION

In one aspect, the invention is a process for producing a ceramic-metal composite body exhibiting binder enrichment and improved fracture toughness at its surface. The process involves forming a shaped body from a homogeneous mixture consisting essentially of: (a) a metallic binder selected from cobalt, nickel, and alloys thereof, (b) excess carbon in a form selected from elemental carbon and a precursor of carbon, (c) optionally, 0 to less than 5.0 volume percent B-1 carbides, and (d) remainder tungsten carbide. The binder is present, in the case of cobalt, in an amount of about 2–15 weight percent, in the case of nickel, in an amount of about 2–12 weight percent, and, in the case of a cobalt-nickel alloy, in an amount between about 2 and about 12–15 weight percent, the maximum amount increasing with the ratio of cobalt to nickel in the alloy. The total carbon present in the mixture is sufficient to result in an ASTM carbon porosity rating at the core of the ceramic-metal composite body of C06 to C08. The weight ratio of the excess carbon to the binder is about 0.05:1 to 0.037:1. The shaped body is sintered in a vacuum or inert atmosphere at a temperature of at least about 1300° C., for a time sufficient to produce a fully dense sintered body in which the binder serves as an intergranular bonding agent for the tungsten carbide. The sintered body is cooled to ambient temperature such that the cooling rate, at least to about 25° below the eutectic temperature, is no greater than about 150° C./hr.

In a narrower aspect, the sintering step of the above-described process involves sintering the shaped body in a vacuum sufficient to prevent the formation of a layer of the metallic binder on the surface of the sintered body. In a still narrower aspect, a hard refractory coating is applied to the cooled sintered body so formed.

In another aspect of the process, the cooling step of the above-described process may be replaced by a step in which the sintered body is cooled to a holding temperature at or slightly above the eutectic temperature of the mixture, isothermally held at the holding temperature for at least 0.5 hr, and further cooled to ambient temperature. In another aspect, the invention is a fully dense ceramic-metal composite body exhibiting improved fracture toughness at its surface. The body includes a core zone exhibiting an ASTM carbon porosity rating of about C02–C08 and a surface zone exhibiting an ASTM carbon porosity rating of about COO. The surface zone includes an outer surface layer enriched in binder content to a depth of about 5–200 μm and to a degree sufficient to improve fracture toughness at the surface. The body consists essentially of, overall: a metallic binder selected from cobalt, nickel, and alloys thereof; excess carbon in a form selected from elemental carbon and a precursor of carbon; optionally, 0 to less than 5.0 volume percent of B-1 carbides; and remainder tungsten carbide. The binder is present, in the case of cobalt, in an amount of about 2–15 weight percent, in the case of nickel, in an amount of about 2–12 weight percent, and, in the case or a cobalt-nickel alloy, in an amount between about 2 and about 12–15 weight percent, the maximum amount increasing with the ratio of cobalt to nickel in the alloy. The total carbon present in the body overall is sufficient to result in an ASTM carbon porosity rating of C06 to C08 at the core zone, and the weight ratio of the excess carbon to the binder is about 0.05:1 to 0.037:1.

In narrower aspects, the above-described body may or may not include a layer of the metallic binder on the surface of the body. In a still narrower aspect, no layer of the metallic binder is present on the surface of the body, and the body further includes a hard refractory coating on its surface.

BRIEF DESCRIPTION OF THE DRAWINGS

For a better understanding of the present invention, together with other objects, advantages and capabilities thereof, reference is made to the following Description and appended Claims, together with the Drawings, in which:

DETAILED DESCRIPTION OF THE PREFERRED EMBODIMENTS

Figure 1:
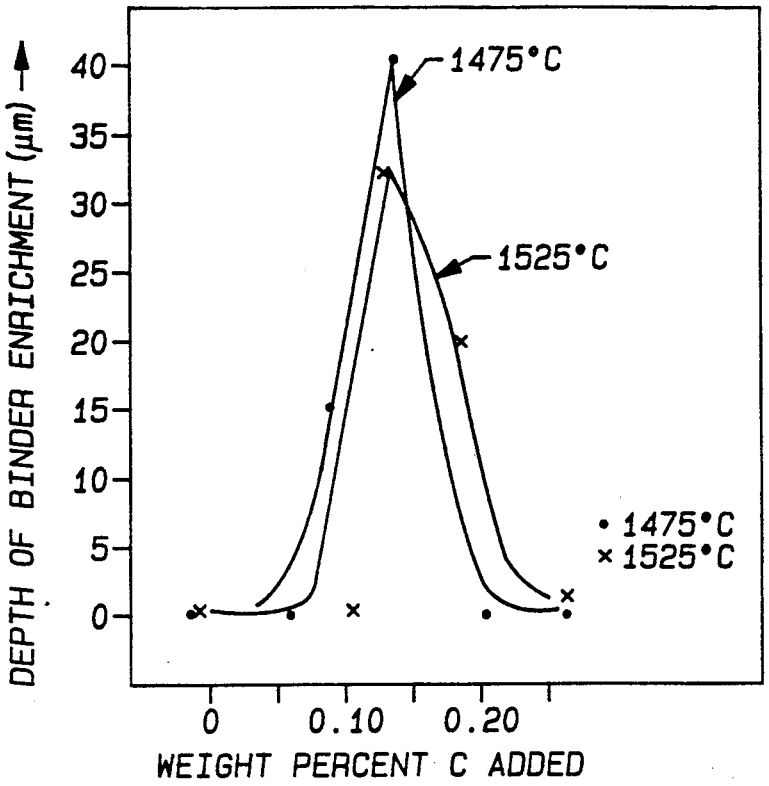
FIG. 1 is a graphical representation of the relationship between excess carbon and surface binder enrichment in bodies in accordance with one embodiment of the invention.

Cemented carbide bodies or articles which are surface toughened by binder enrichment without the inclusion of a B-1 carbide phase are described herein. The achievement of such binder-stratified, surface toughened compositions is unexpected since, as described above, binder-enriched surfaces have heretofore been associated with the creation of β-free layers devoid of, or at least partially depleted of, B-1 carbides. The surface binder enrichment described herein was found to be dependent on the composition of the WC-Co or WC-Ni material, existing only over a very specific range of excess carbon content (C-porosity), and obtainable only by very specific processing conditions.

The bodies described herein are formed from a B-1 free composition or from a composition containing less than 5 v/o (volume percent) B-1 carbides, preferably no more than about 2–3 v/o, and a slight excess of carbon in a tungsten carbide-metal binder composition. (Any small amounts of B-1 carbides, if added, are present for such purposes as control of grain growth.) This low B-1 carbide content, if present, amounts to, e.g., less than about 0.66–1% w/o (weight percent) for TiC, and less than about 2–3 w/o for TaC.

As used herein, the term "excess carbon" is intended to indicate carbon added in excess of that derived from the WC raw material, assuming near-stoichiometric quality WC having a total carbon content of about 6.13 w/o. However, the amount of carbon added to the mixture to create the desired amount of excess carbon may have to be adjusted to compensate for a non-stoichiometric amount of carbon in the WC starting powder. The bodies described herein exhibit C-porosity, as defined above, with carbon present in the microstructure of the sintered body. However, before the invention of the process described herein, this C-porosity was believed unrelated to the achievement of surface binder enrichment, and processing conditions to produce surface binder enrichment in such carbon precipitated materials, therefore, were not explored.

We have found that binder enrichment can be induced at the surface of a substrate of the particular materials described herein without the presence of B-1 carbides in the substrate, only under certain sintering-/cooling conditions, described below. To produce this binder enrichment, the substrate materials must contain this excess carbon only within a narrow range of carefully controlled, very low levels, beginning at the level producing about an ASTM C02 porosity rating. The actual carbon content required to produce the necessary C-porosity varies slightly with metallic binder content, increasing slightly with increasing amounts of metal in the ceramic-metal composition. Under the required sintering/cooling conditions, increasing the level of excess carbon results in increased binder enrichment, but only up to about an excess carbon content corresponding approximately to that between an ASTM C06 and C08 porosity rating, that is, not higher than about a C08 rating. With further increases in the excess carbon content, the near surface binder enrichment decreases, until the excess carbon content exceeds the solubility limit of carbon in the metal binder. Thereafter, much unreacted carbon is observed in the microstructure and no binder enrichment occurs. For example, surface binder enrichment may be effected in a tungsten carbide cutting tool containing 6 w/o cobalt binder if the amount of precipitated excess carbon is within the range of about 0.05–0.20 w/o (weight percent), typically about 0.15 w/o, provided the remaining requirements of composition and sintering/cooling conditions are met.

The binder enrichment is also affected by the metallic binder content of the ceramic-metal composition. For example, in an exemplary composition of tungsten carbide containing 2–14 w/o cobalt, the excess carbon content needed for cobalt surface enrichment to occur is about 0.05–0.37 w/o, typically 0.013–0.037 grams of excess carbon per gram of cobalt. The amount of excess carbon required increases with increasing cobalt content. The enrichment effect is not found above about 15 w/o cobalt regardless of excess carbon level or sintering process. In the case of a nickel binder, the maximum metallic binder content for enrichment is about 12 w/o; for cobalt-nickel alloys, a maximum amount between 12 w/o and 15 w/o, increasing with the cobalt:nickel content ratio.

The metallic binder may be either cobalt or nickel, or may be a cobalt-nickel alloy. As used herein, the terms "cobalt", "nickel", and "cobalt-nickel alloy" may include about 5–30 w/o chromium, based on the weight of the metallic binder, to improve the corrosion resistance of the body. For WC containing 6 w/o cobalt, this would amount to about 0.3–1.8 w/o chromium, based on the total weight of the body. Cobalt cemented ceramic-metal bodies may be used as, inter alia, cutting tools. Nickel cemented bodies are suitable for use in, inter alia, structural applications such as metal-ceramic seals.

Finally, binder enrichment is dependent on the sintering temperature and particularly on the cooling schedule of the high temperature sintering cycle. The sintering temperature is at least about 1300° C., typically about 1325°–1525° C., but may be up to about 1600° C. The body is sintered for a time sufficient to effect full density, typically at least about 99% of the theoretical density, typically about 5 min to 11 hours. In a typical cooling schedule for the process described herein, the cooling rate from the sintering temperature to at least about 25° below the eutectic temperature, typically at least to about 1250° C., is controlled to be below about 150° C./hr, for example about 5°–150° C./hr, and typically about 50° C./hr.

Alternatively, the above-described cooling step may be adapted to include an isothermal holding period to increase the depth of the binder-enriched region at the surface of the sintered blank. In this process, the sintered blanks may be cooled to a temperature at or slightly above the eutectic temperature, held at that temperature for a period of time, and further cooled using controlled cooling, as described above, to at least about 25° below the eutectic temperature, typically at least to about 1250°–1200° C. Alternatively, the blanks may be cooled completely to ambient using controlled cooling. The effective temperature range for such an isothermal hold above the eutectic temperature is about 1275°–1295° C., typically about 1280° C. The isothermal hold time may be, e.g., about 0.5–3 hr, typically about 1 hr.

According to another alternative, if the temperature for the isothermal hold is kept within a narrower range of near 1280° C., typically about 1275°–1285° C., for the same time period range the controlled cooling step may be eliminated. For example, the blanks may be furnace quenched to a holding temperature near 1280° F., then isothermally heat treated at that temperature, and furnace quenched again to ambient. As used herein, the term "furnace quenched" means that the oven is turned off and the sintered blanks allowed to cool to the desired temperature within the closed furnace. This method results in a cooling rate of, typically, about 900°–1200° C./hr, and is effective in producing the desired surface binder enrichment in sintered blanks formulated in the same manner as described above for the slow cooled, binder-enriched sintered blanks.

The microstructure of sintered, binder stratified articles formulated and processed as described herein exhibit a carbon gradient with C-porosity at the core and C00 porosity (no excess carbon) at the surface. Typically, the carbon depleted zone is of greater depth than the binder-enriched zone. The sintered articles exhibit a microstructure in which the binder content is a maximum at the surface, decreasing gradually with depth from the surface until it reaches the bulk value. In the region of increased binder content, the article exhibits a stratified microstructure with the metal binder appearing as "wavelets" in the binder-enriched zone. This microstructure is similar to that found in a surface binder stratified article that contains B-1 carbides, as described above, except that no B-1 carbides are present.

For certain applications such as cutting tools the bodies described herein may be coated by known means with refractory materials to provide certain desired surface characteristics. Examples of methods for applying the coatings include chemical and physical vapor deposition processes known to be suitable for metal cemented carbide materials. Typical suitable methods are described in U.S. Pat. No. 5,089,047, incorporated herein by reference. The preferred coatings have one or more adherent, compositionally distinct layers of refractory metal carbides and/or nitrides, e.g. of titanium, tantalum, or hafnium, and/or oxides, e.g. of aluminum or zirconium, or combinations of these materials as different layers and/or solid solutions. Especially preferred for the bodies described herein are coatings having titanium carbide directly deposited on the fracture-toughened, binder-enriched surface, either as the sole coating or combined with various outer layers. Examples of such coatings are titanium carbide/alumina, titanium carbide/titanium nitride, and titanium carbide/alumina/titanium nitride.

The following Examples are presented to enable those skilled in the art to more clearly understand and practice the present invention. These Examples should not be considered as a limitation upon the scope of the present invention, but merely as being illustrative and representative thereof.

EXAMPLE 1

A series of WC-Co substrate samples, Samples 1–10, Table I, were prepared with varying amounts of carbon added in excess of that derived from the WC raw material. The sample mixtures were mixed by standard attritor milling powder processing techniques.

Sample blanks 0.625 in.×0.625 in.×0.250 in. were pill-pressed from the mixtures, $H_2$-dewaxed, and subsequently sintered in vacuum of about 80 μm in a sealed graphite boat for 1 hour at either 1475° C. or 1525° C. The samples were cooled by furnace quenching or by controlled cooling at 50° C./hr to 1200° C. followed by furnace quenching. Polished cross sections of the sintered cooled samples were evaluated for the degree of surface binder enrichment, using an optical microscope.

TABLE I

| Sample | Composition, w/o WC/Co | Excess C | Total C |
|---|---|---|---|
| 1 | 94*/6 | 0 | 5.79 |
| 2 | 94*/6 | 0.05 | 5.84 |
| 3 | 94*/6 | 0.10 | 5.89 |
| 4 | 94*/6 | 0.15 | 5.94 |

TABLE I-continued

| Sample | Composition, w/o WC/Co | Excess C | Total C |
|---|---|---|---|
| 5 | 94*/6 | 0.20 | 5.99 |
| 6 | 94*/6 | 0.25 | 6.04 |
| 7 | 94*/6 | 0.185 | 5.98 |
| 8 | 94 /6 | 0.185 | 5.98 |
| 9 | 97 /3 | 0 | 5.98 |
| 10 | 97*/3 | 0 | 5.98 |

*13.7 μm WC powder.
4.0 μm WC powder.

Test blanks sintered at 1475° c. or 1525° C. and furnace quenched showed no evidence of surface binder enrichment. Blanks cooled from 1475° C. or 1525° C. by controlled cooling (50° C./hr) showed, in some blanks, binder-enriched surfaces up to 50 μm in depth. As shown in FIG. 1, however, the degree of binder enrichment varied with carbon content, exhibiting a maximum binder enrichment depth at 0.15 w/o carbon added to WC+6 w/o Co, or 5.94 w/o total carbon in the mixture. FIG. 1 is a graphical representation of the variation of the average depth of binder enrichment with excess carbon content for these samples at sintering temperatures of 1475° C. and 1525° C. These results are unexpected, since these cemented carbides contained no B-1 carbide phase (β-phase). As stated above, one of ordinary skill in the art would consider the presence of significant B-1 carbide phase necessary to the surface binder enrichment process.

Analysis of the slow cooled samples showed C-porosity at about 0.10 w/o addition, and some FA or FB porosity in the samples containing greater than about 0.15 w/o carbon addition. FA or FB porosity refers to filled A or filled B porosity, respectively. That is, some excess carbon is unreacted or undissolved (in the binder) and is not reprecipitated during sintering, thus is present in the microstructure in its as-added form. Increasing the sintering temperature by 50° C., from 1475° C. to 1525° C., tended to decrease the carbon concentration in the sintered materials, and to decrease the residual type FA and FB porosity levels, shifting the binder enrichment depth curve in FIG. 1 to the right.

In the furnace quenched samples, no microstructural differences in cobalt concentration were observed from center to surface of the sintered blanks. Blanks pressed from Samples 1, 9, and 10, with no carbon addition, and Sample 2, with insufficient carbon addition, also showed no surface binder enrichment, even when cooled from sintering temperature to 1200° C. at 50° C./hr. Differences in cobalt distribution were, however, observed for the blanks made from Samples 3–8 when cooled from sintering temperature under controlled conditions (50° C./hr to 1200° C.). A slight binder enrichment was indicated at 0.10 w/o added carbon (at 1475° C., controlled cooling), while appreciable enrichment to a depth of 40–50 μm was observed at 0.15 w/o added carbon (at either temperature with controlled cooling). Microhardness measurements (Vickers microhardness at 1 Kg) confirm this observation; the center, or core, of blanks fabricated from Sample 4 (0.15 w/o excess carbon) had an average hardness of 15.4 GPa, while the hardness at an average distance of 45 μm from the edge was 13.4 GPa. Since hardness decreases with increasing binder content, this confirms the binder enrichment. At higher levels of carbon, the depth and degree of cobalt enrichment tended to decrease with increasing carbon levels until, at 0.25 w/o carbon, binder enrichment was not observed.

EXAMPLE 2

An additional series of sample mixtures was prepared as described for Example 1. In these samples the tungsten carbide was added as 13.7 μm or 4.0 μm powder or as a 50/50 (by weight) blend of the two. Also, since the best results in Example 1 were achieved at 0.15 w/o excess carbon, the added carbon in this Example was bracketed on a finer scale about this value, that is, with 0.132 w/o, 0.150 w/o or 0.168 w/o excess carbon. The samples were sintered in vacuum (about 80 μm) in a sealed graphite boat at 1475° C. for one hour and subsequently cooled at three rates, furnace quench (about 900°-1200° C./hr), 100° C./hr, and 50° C./hr. Characterization of the sintered microstructures are shown in Table II.

TABLE II

| Sample | WC, μm | Co, w/o | Excess C, w/o | C00 Zone Depth, μm | Binder Enr. Zone Depth, μm |
|---|---|---|---|---|---|
| | | Cooling rate = 900-1200° C./hr: | | | |
| 11 | 13.7 | 6 | +0.132 | 50 | 0 |
| 12 | 13.7 | 6 | +0.150 | 60 | 0 |
| 13 | 13.4 | 6 | +0.168 | 50 | 0 |
| 14 | 4.0 | 6 | +0.132 | 50 | 0 |
| 15 | 4.0 | 6 | +0.150 | 60 | 0 |
| 16 | 4.0 | 6 | +0.168 | 50 | 0 |
| 17 | blend* | 6 | +0.150 | 55 | 0 |
| | | Cooling rate = 100° C./hr: | | | |
| 18 | 13.7 | 6 | +0.132 | 100 | 20 |
| 19 | 13.7 | 6 | +0.150 | 110 | 20 |
| 20 | 13.4 | 6 | +0.168 | 100 | 20 |
| 21 | 4.0 | 6 | +0.132 | 120 | 10 |
| 22 | 4.0 | 6 | +0.150 | 110 | 20 |
| 23 | 4.0 | 6 | +0.168 | 110 | 20 |
| 24 | blend* | 6 | +0.150 | 110 | 20 |
| | | Cooling rate = 50° C./hr: | | | |
| 25 | 13.7 | 6 | +0.132 | 120 | 30 |
| 26 | 13.7 | 6 | +0.150 | 125 | 35 |
| 27 | 13.7 | 6 | +0.168 | 120 | 25 |
| 28 | 4.0 | 6 | +0.132 | 120 | 30 |
| 29 | 4.0 | 6 | +0.150 | 140 | 35 |
| 30 | 4.0 | 6 | +0.168 | 130 | 25 |
| 31 | blend* | 6 | +0.150 | 130 | 30 |

*WC powder was a 50/50 blend by weight of 13.7 μm and 4.0 μm powders.

Figure 2:
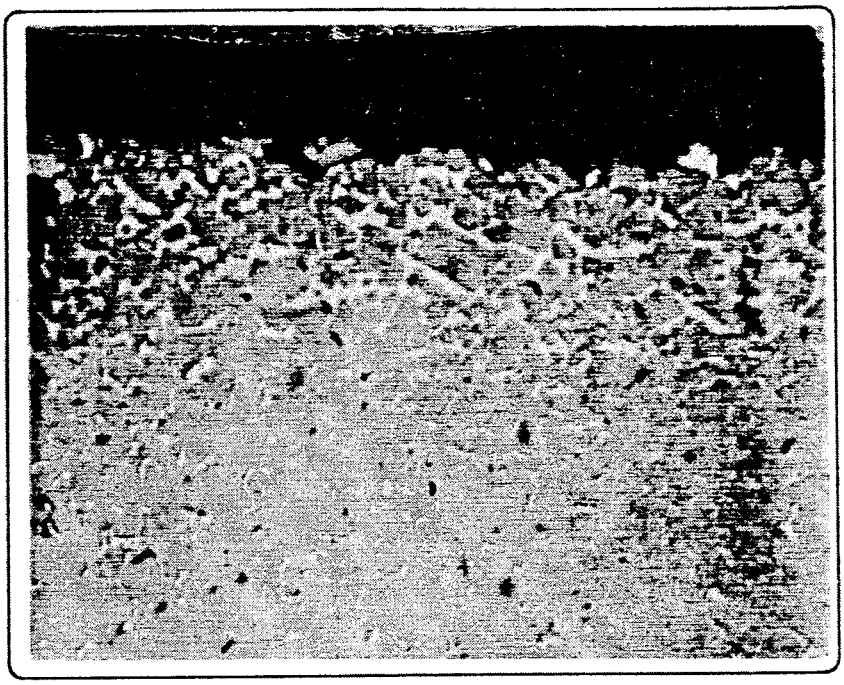
FIGS. 2 and 3 are photomicrographs showing the near-surface binder enrichment in bodies in accordance with other embodiments of the invention.
Figure 3:
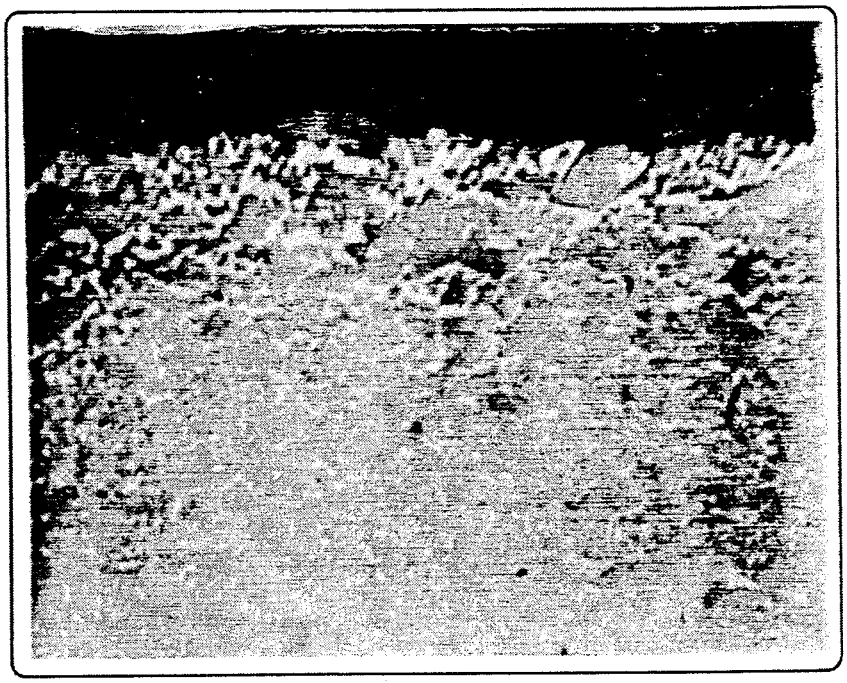

As shown in Table II, the furnace quenched samples exhibited no binder-enriched layer (Binder Enr. Zone) and only slight (about 50 μm) carbon porosity-free near-surface layers (COO zone) having no precipitated excess carbon. Decreasing the cooling rate to controlled cooling conditions (100° C./hr and 50° C./hr) produced binder enrichment, increasing in depth as the cooling rate decreased, and increased the depth of the carbon porosity-free layer. The tungsten carbide grain size appeared to have no significant effect on binder enrichment. This is confirmed by the photomicrographs of FIGS. 2 and 3, showing sintered bodies containing WC+6 w/o Co+0.15 w/o excess carbon, using 13.7 μm and 4.0 μm tungsten carbide powder respectively. Similar degrees of binder enrichment are evident, with the binder creating a somewhat stratified ("wavelet") microstructure in each blank. Quantitative stereology of these cross sections yielded similar results, 28.6 and 27.6 area-% of binder in the binder-enriched zones compared to about 9 area-% and about 8 area-% of binder in the interior for the materials of FIGS. 2 and 3, respectively.

The results described in Example 1 and 2 show that near surface binder enrichment occurs over a narrow range of excess carbon and is greatly affected by cooling rate. The WC powder size, however, appears to have no significant effect on the near surface binder enrichment.

EXAMPLE 3

A series of WC-6 w/o Co mixtures with 0%, 0.132 w/o, 0.150 w/o, and 0.168 w/o excess carbon, respectively, was prepared as described for Example 1, and was used to further explore the effects of sintering temperature, sintering time, and cooling rate.

Isothermal (1475° C.) sintering experiments were performed on blanks prepared as described for Example 1 from these compositions. Sintering including 1 hour, 3 hour, and 6.5 hour holds at sintering temperature followed by furnace quenching (about 900°-1200° C./hr) failed to produce binder-enriched near surface regions. A two-step sintering process (1475° C./1 hr, furnace quench to 1375° C. and hold for 3 hours followed by a furnace quench to ambient temperature) also did not produce binder enrichment. Thus time at sintering temperature, absent the slow cooling described above, had negligible effect on producing the high binder content near surface layer.

Controlled cooling (50° C./hr or 100° C./hr) from sintering temperature was observed to yield binder-enriched layers irrespective of sintering temperature, but only in those blanks exhibiting C-porosity due to excess carbon. The blanks made from the samples containing 0.132 w/o and 0.150 w/o excess carbon exhibited C-porosity at about C04 porosity and about C06/08 porosity, respectively, while the blank containing 0.168 w/o excess carbon exhibited about C08 porosity with some FA (filled A) porosity at the core. The binder-enriched zone depth increased as the cooling rate decreased. No binder enrichment was observed for the mixture to which no excess carbon was added, regardless of the sintering/cooling conditions. It was also noted that, although a small (55 μm) COO zone (WC-Co layer with no precipitated excess carbon in that layer) was present in the furnace quenched samples, the depth of this C00 zone increased dramatically (125-150 μm) at the slower cooling rate where binder-enriched near surface layers were observed.

EXAMPLE 4

A series of WC-6 w/o Co mixtures with 0%, 0.132 w/o, 0.150 w/o, and 0.168 w/o excess carbon, respectively, was prepared as described for Example 1, and blanks were prepared from each sample mixture, as described above for Example 1, to further explore the criticality of the cooling rate in the binder enrichment process. Sintering tests were performed on these blanks according to the following sintering schedules:

(A) Heat to 1475° C.: hold for 1 hr; furnace quench to 1325° C.: hold for 1 hr; furnace quench to ambient.

(B) Heat to 1475° C.: hold for 1 hr; furnace quench to 1325° C.: hold for 1 hr; cool at 50° C./hr to 1200° C.: furnace quench to ambient.

(C) Heat to 1475° C.: hold for 1 hr; cool at 50° C./hr to 1325° C.: furnace quench to ambient.

As shown in Table III, only Schedule B produced binder-enriched near surface layers, and only for the C-porosity formulations containing 0.132 w/o, 0.150 w/o, and 0.168 w/o excess carbon. No enrichment was produced in the carbon-balanced material (0% excess carbon) by any of these sintering schedules. Controlled cooling from 1475° C. to 1325° C. did not cause binder enrichment in any of the blanks. Controlled cooling from the 1325° C. temperature to at least as low as 1200° C. is thus shown to be effective in producing surface binder enrichment in blanks of the required composition.

TABLE III

| Sintering Schedule | Carbon Content, w/o | Binder Enrichment? |
|---|---|---|
| A | 0 | no |
| | 0.132 | no |
| | 0.150 | no |
| | 0.168 | no |
| B | 0 | no |
| | 0.132 | yes |
| | 0.150 | yes |
| | 0.168 | yes |
| C | 0 | no |
| | 0.132 | no |
| | 0.150 | no |
| | 0.168 | no |

EXAMPLE 5

Further samples were prepared as described in Example 1 containing varying amounts of carbon and cobalt, as shown in Table IV, balance tungsten carbide. Blanks prepared from these samples, as described in Example 1, were sintered in a closed graphite boat in vacuum at 1475° C. for 1 hour, cooled, and examined for binder enrichment. Samples 32–36 were cooled to ambient at 50° C./hr; Samples 37–45 were furnace quenched (at 900°–1200° C./hr) to 1325° C., cooled at 50° C./hr to 1200° C., and furnace quenched to ambient. The results are shown in Table IV.

As shown, binder enrichment was observed in the samples containing 3–12 w/o cobalt and up to a C08 carbon porosity rating. No binder-enriched near-surface layers were observed in any of the 16 w/o cobalt samples, or in the sample having greater than a C08 porosity. Thus, both the amount of excess precipitated carbon and the cobalt content are shown to be contributing factors to binder enrichment in these B-1 free materials.

TABLE IV

| Sample | Co, w/o | Carbon Content | Binder Enr. Zone Depth*, μm |
|---|---|---|---|
| 32 | 3 | C04 | 25 |
| 33 | 6 | C06 | 50 |
| 34 | 9 | C06/08 | 50 |
| 35 | 12 | C08 | 40 |
| 36 | 16 | >C08 | None |
| 37 | 16 | 5.05 w/o total | None |
| 38 | 16 | 5.10 w/o total | None |
| 39 | 16 | 5.15 w/o total | None |
| 40 | 16 | 5.20 w/o total | None |
| 41 | 16 | 5.25 w/o total | None |
| 42 | 16 | 5.30 w/o total | None |
| 43 | 16 | 5.35 w/o total | None |
| 44 | 16 | 5.40 w/o total | None |
| 45 | 16 | 5.45 w/o total | None |

*Approximate average values.
Between C06 and C08.
Carbon balanced mixture (0% excess carbon).

EXAMPLE 6

Four samples of tungsten carbide powder (2 μm size), cobalt powder (8 μm size) in an amount of 4.0 w/o, and estimated, different amounts of carbon powder were ball-milled in heptane for 24 hr, screened to remove agglomerates, dried, mixed with 1.5 w/o paraffin wax (in a solvent), and allowed to dry during mixing of the powder. The composition of each sample was then adjusted to achieve the desired carbon content, attempting a difference of 0.01 w/o carbon content between the samples. The actual compositions achieved are shown below. The samples were then remilled and cutting tool inserts were pressed from each sample. The cutting tool inserts each measured ½ in.×½ in.×3/16 in. The inserts were dewaxed at 420° C. for 90 min, and sintered at 1200° C. for 40 min then at 1400° C. for 100 min, under 1 torr argon. The inserts were then slow cooled at 60° C./hr under 1 torr argon to 1245° C., and furnace quenched to ambient.

Analysis of the resulting sintered inserts showed the compositions to be WC.+4.0 w/o Co+carbon in amounts as follows: Sample 46=5.93 w/o; Sample 47=5.94 w/o; Sample 48=5.96 w/o; Sample 49=5.96 w/o carbon. All of these inserts contained <0.1 w/o TiC. and <0.1 w/o TaC. A commercially available, B-1 carbide containing, surface binder-enriched insert was also analyzed and found to contain 2.6 w/o TiC, 5.8 w/o TaC, 5.8 w/o Co, 6.19 w/o carbon, remainder WC. All analysis figures are accurate to ±0.02 w/o.

Figure 4:
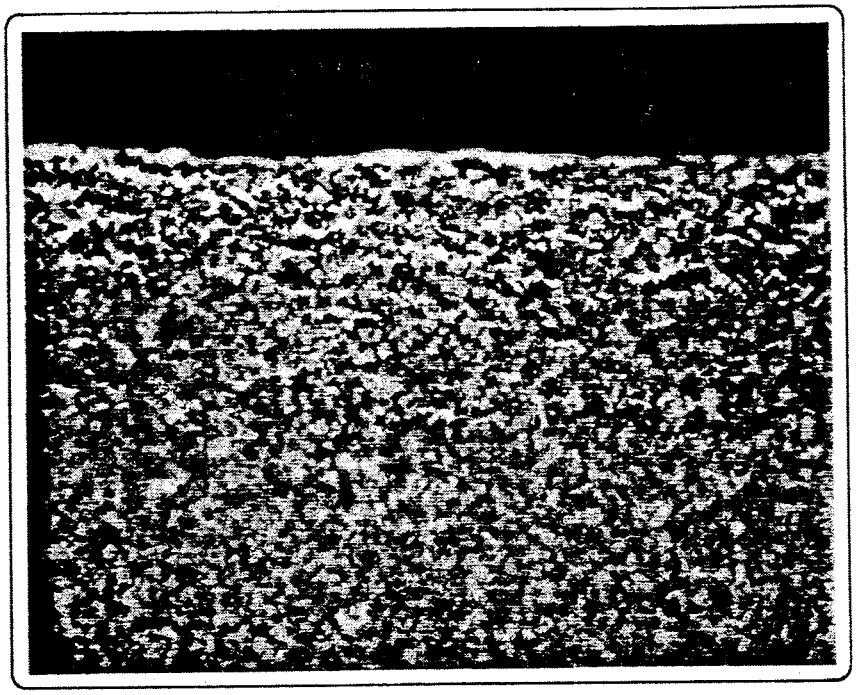
FIG. 4 is a photomicrograph showing near-surface binder enrichment in a body in accordance with still another embodiment of the present invention.
Figure 5:
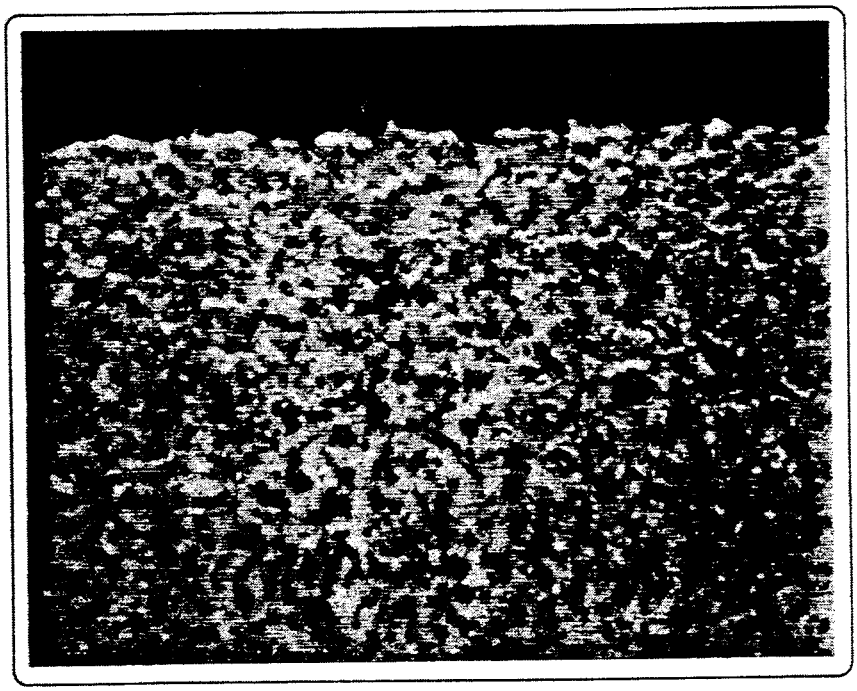
FIG. 5 is a photomicrograph showing near-surface binder enrichment in a prior art body.

The inserts were cross-sectioned, mounted and polished, then examined using an optical microscope. FIGS. 4 and 5 show the polished cross-section of the insert from Sample 48 and of the binder-enriched commercially available insert, respectively. The microstructures of the polished cross-sections of the inserts containing no significant β-phase materials all exhibited C06 carbon porosity, with the depths of binder enrichment as follows: Sample 46=25 μm; Sample 47=25–30 μm; Sample 48=40 μm; Sample 49=40–45 μm. Sample 49, however, exhibited some rough carbon layers. The occurrence of a small amount of rough carbon layers is observed just before the onset of FA porosity. Thus binder stratification is achievable without B-1 carbides at a binder content of 4 w/o, and by slow cooling to about 1245° C.

A comparison of the microstructure of FIG. 4 with those of FIGS. 2 and 3 illustrates an additional advantage of the method described herein. In the cross section shown in FIG. 4, a thin layer of cobalt is observed coating the surface of the sintered material, over the binder-enriched layer, while no such thin cobalt layer is present at the material surfaces shown in FIGS. 2 and 3. It has been found that the sintering process may be adapted either to produce a metallic binder surface layer or to produce no such surface layer, as desired, by varying the sintering temperature and/or the atmosphere in which the sintering is carried out. As described above in Example 2, the materials of FIGS. 2 and 3 were sintered at about 1475° C. under about 80 μm vacuum. In this Example, the material of FIG. 4 was sintered at about 1400° C. under 1 torr argon atmosphere. It appears that the higher vacuum and temperature used in Example 2 resulted in evaporation of cobalt migrating to the outer surface of the material, preventing the formation of the thin layer of metallic binder component over the surface of the blank. Thus one may preselect the presence or lack of, and even the thickness of such a thin surface binder layer by adjusting the sintering atmosphere and temperature.

The advantage lies in the ability to specifically tailor the material to the use for which the tool is intended. At present, if a blank is intended for use as a substrate to which a hard refractory coating will be applied, any binder metal forming a coating on the surface of the blank must be removed in a separate processing step before the hard refractory coating can be applied. The binder coating typically is removed by, for example, a chemical or mechanical process. Failure to completely remove this layer results in poor adhesion of the applied refractory coating. Use of a temperature and vacuum similar to that used in Example 2 can obviate the need for this extra processing step in the manufacture of coated tools. However, in the case of an uncoated mining tool to be brazed into, e.g., a steel tool holder for use in a mine roof drill, the production of a thin, e.g., cobalt layer, by using a lower sintering temperature and an inert atmosphere at a higher pressure, can provide a more easily brazable tool.

EXAMPLE 7

A WC-6 w/o Ni composition was prepared by standard attritor milling of a mixture of 13.7 μm WC. powder with carbon and nickel powders. The mixture was dried, screened, pill-pressed, and dewaxed as described above for Example 1. The carbon content of the powder mixture was adjusted to yield a sintered, dense body which exhibited excess carbon porosity rated C06/08. Samples were sintered at 1475° C. for 1 hr, furnace quenched to 1325° C., held at 1325° C. for 1 hr, and cooled to 1200° C. at 50° /hr. A near surface C00 zone 150 μm deep was generated in these samples. Binder-enriched near surface layers were observed to a depth of about 75 μm.

Thus, the substitution of nickel for cobalt as a binder does not appear to change the binder enrichment effect when other requirements, as described above, are met.

EXAMPLE 8

Blanks were fabricated and prepared for sintering as described for Example 1, using various B-1 free mixtures of WC+6 w/o Co+carbon in amounts as follows: Sample 50=0%; Sample 51=0.132 w/o; Sample 52=0.150 w/o excess carbon. The set of blanks from each mixture sample was then sintered and cooled identically, sintering at 1475° C. for 1 hr, cooling by furnace quenching to 1280° C., isothermally holding at 1280° C. for various times, and furnace quenching to ambient.

Figure 6:
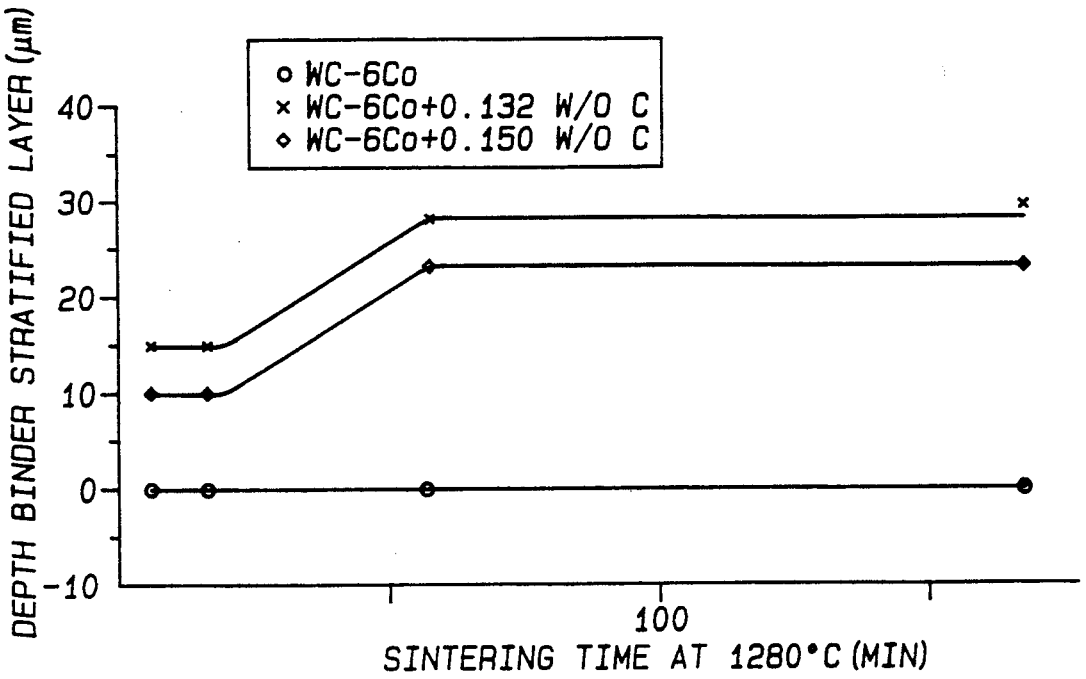
FIG. 6 is a graphical representation of the relationship between isothermal hold time and surface binder enrichment in bodies in accordance with yet another embodiment of the invention.

As may be seen in FIG. 6, no binder-enriched zone was produced in blanks of Sample 50 containing no excess carbon. The depth of the binder-enriched zone increased with increasing time of holding at 1280° C. up to about a 1 hr holding time for the blanks of Samples 51 and 52.

EXAMPLE 9

Blanks were fabricated and prepared for sintering as described for Example 1, using a mixture of WC+6 w/o Ni and an amount of carbon calculated to produce ASTM C06–C08 precipitated carbon porosity. The blanks were then sintered at 1475° C. for 1 hr, and cooled with an isothermal hold, as shown in Table V.

TABLE V

| Schedule | Hold | Cooling | Core C-Porosity Rating | Near-Surface C00 Zone Depth, μm | Binder Enr. Near-Surface Zone Depth, μm |
|---|---|---|---|---|---|
| D | 1325° C. 1 hr | 50° C./hr 1325–1200° C. | C06/08 | 150 | 75 |
| E | 1280° C. 5 min | F. quench | C08 | 50 | 20 |
| F | 1280° C. 15 min | F. quench | C08 | 80 | 30 |
| G | 1280° C. 30 min | F. quench | C08 | 125 | 40 |
| H | 1280° C. 180 min | F. quench | C06 | 115 | 40 |

Isothermal heat treating at 1280° C. under each of the conditions shown in Table V produced surface binder-enriched sintered blanks having a carbon-rich core rated at a C06–C08 porosity, and an outer layer exhibiting near-surface Ni binder enrichment and no precipitated carbon (C00 zone) to the depths shown in Table V. Blanks prepared in a similar manner, except that the amount of nickel included was 12 w/o, exhibited minimal binder enrichment.

Additions of high amounts of β-phase, or B-1 carbides, to prior art WC-Co compositions make such materials more difficult to sinter, requiring higher sintering temperatures. Production-scale powder blending is complicated by the difficulty of exact addition of the specified amounts of TiC. and/or TaC. Also, TaC. powder is expensive, at a cost of approximately three times that of WC powder. The ability to stratify the near-surface region of B-1 free metal cemented carbide compositions means that higher toughness can be achieved in, for example, cutting tools containing little or no B-1 carbides without sacrificing deformation resistance.

The ability to specifically tailor a ceramic-metal material to the use for which the tool is intended is also an important advantage offered by the method described herein. As described above, any binder metal forming a layer on the surface of a blank intended for use as a coated tool must be removed in a separate processing step before the refractory coating can be applied. Failure to completely remove this layer results in poor adhesion of the applied refractory coating. Use of the appropriate temperature and vacuum level, as described above, can obviate the need for this extra processing step in the manufacture of coated tools. The presence on the surface of a mining tool of a thin, e.g., cobalt layer created by sintering at the appropriate temperature and vacuum level can facilitate brazing of the stratified ceramic-metal tools described herein onto the steel tool holders of mine roof drills. Also, as shown in the Examples, the depth of the enriched zone and the amount of binder in the enriched zone can be controlled; thus, the toughness of a tool can be tailored to the anticipated machining conditions.

Thus, the surface toughened WC-Co bodies described herein, containing no B-1 carbides (or amounts considered insufficient by those of ordinary skill in the art), are more economical and produce a more "robust" end product which is easier to obtain with consistency. The sintered blanks may be specifically tailored to the use for which the tool is intended. A blank for application of a refractory coating may be produced without any binder metal layer on its surface, eliminating the need for a separate processing step to remove the metallic binder layer before the refractory coating can be applied.

As an uncoated, highly fracture resistant tool, the body is suitable for use, for example, in roof drilling of hard rock. Often, in drilling holes for mine roof bolts, the operator must changed from a harder to a more fracture resistant insert when hard rock is encountered. These inserts may readily be brazed into a steel tool holder when a cobalt or other binder metal layer of preselected thickness is produced over the binder-enriched layer, as described above. These cobalt stratified materials may also be used as mining tool inserts readily brazable into conventional steel holders for such applications as mine roof drilling tools, long wall mining tools for coal mining, and road milling tools.

While there has been shown and described what are at present considered the preferred embodiments of the invention, it will be obvious to those skilled in the art that various changes and modifications can be made therein without departing from the scope of the invention as defined by the appended Claims.

We claim:

1. A process for producing a ceramic-metal composite body exhibiting binder enrichment and improved fracture toughness at its surface, said process comprising the steps of:

forming a shaped body from a homogeneous mixture consisting essentially of: (a) a metallic binder selected from the group consisting of cobalt, nickel, and alloys thereof, (b) excess carbon in a form selected from the group consisting of elemental carbon and a precursor of carbon, wherein the total carbon present in said mixture is sufficient to result in an ASTM carbon porosity rating at the core of said ceramic-metal composite body of C06 to C08, the weight ratio of said excess carbon to said binder being about 0.05:1 to 0.037:1, (c) optionally, 0 to less than 5.0 volume percent B-1 carbides, and (d) remainder tungsten carbide; wherein said metallic binder is present, in the case of cobalt, in an amount of about 2–15 weight percent, in the case of nickel, in an amount of about 2–12 weight percent, and, in the case of said alloy thereof, in an amount between about 2 and 12–15 weight percent, the maximum increasing with the ratio of cobalt to nickel in said alloy;

sintering said shaped body in a vacuum or inert atmosphere at a temperature of at least about 1300° C., said sintering step being carried out for a time sufficient to produce a fully dense sintered body in which said binder serves as an intergranular bonding agent for said tungsten carbide; and cooling said sintered body to ambient temperature such that the cooling rate, at least to about 25° below the eutectic temperature of said mixture, is no greater than about 150° C./hr.

2. A process in accordance with claim 1 wherein said metallic binder is cobalt in an amount of about 6 weight percent, and said total carbon present in said mixture is about 0.05–0.20 weight percent in excess of that required to produce excess carbon porosity.

3. A process in accordance with claim 1 wherein said metallic binder is cobalt in an amount of about 6 weight percent and said excess-carbon to cobalt ratio in said mixture is 0.013:1 to 0.037:1.

4. A process in accordance with claim 1 wherein said sintering step comprises sintering said shaped body at a temperature and in a vacuum sufficient to prevent the formation of a coating consisting essentially of said metallic binder on the surface of said sintered body; and further comprising the step of applying a hard refractory coating to said cooled sintered body.

5. A process in accordance with claim 1 wherein said sintering step comprises sintering said shaped body at a temperature and in a vacuum selected to promote the formation of a coating consisting essentially of said metallic binder on the surface of said sintered body.

6. A process in accordance with claim 5 further comprising the steps of removing said metallic binder coating from said surface of said sintered body; and applying a hard refractory coating to said cooled sintered body.

7. A process for producing a ceramic-metal composite body exhibiting binder enrichment and improved fracture toughness at its surface, said process comprising the steps of:

forming a shaped body from a homogeneous mixture consisting essentially of: (a) a metallic binder selected from the group consisting of cobalt, nickel, and alloys thereof, (b) excess carbon in a form selected from the group consisting of elemental carbon and a precursor of carbon, wherein the total carbon present in said mixture is sufficient to result in an ASTM carbon porosity rating at the core of said ceramic-metal composite body of C06 to C08, the weight ratio of said excess carbon to said binder being about 0.05:1 to 0.037:1, (c) optionally, 0 to less than 5.0 volume percent B-1 carbides, and (d) remainder tungsten carbide; wherein said metallic binder is present, in the case of cobalt, in an amount of about 2–15 weight percent, in the case of nickel, in an amount of about 2–12 weight percent, and, in the case of said alloy thereof, in an amount between about 2 and 12–15 weight percent, the maximum increasing with the ratio of cobalt to nickel in said alloy;

sintering said shaped body in a vacuum or inert atmosphere at a temperature of at least about 1300° C., said sintering step being carried out for a time sufficient to produce a fully dense sintered body in which said binder serves as an intergranular bonding agent for said tungsten carbide; and cooling said sintered body to a holding temperature at or about the eutectic temperature of said mixture, isothermally holding said sintered body at said holding temperature for at least 0.5 hr, and further cooling said sintered body to ambient temperature.

8. A process in accordance with claim 7 wherein said metallic binder is cobalt in an amount of about 6 weight percent, and said total carbon present in said mixture is about 0.05–0.20 weight percent in excess of that required to produce excess carbon porosity.

9. A process in accordance with claim 7 wherein said metallic binder is cobalt in an amount of about 6 weight percent and said excess-carbon to cobalt ratio in said mixture is 0.013:1 to 0.037:1.

10. A process in accordance with claim 7 wherein said holding temperature is about 1275°–1285° C.

11. A process in accordance with claim 7 wherein said holding temperature is about 1275°–1295° C. and said cooling step comprises cooling said sintered body such that the cooling rate, at least to about 25° below said eutectic temperature, is no greater than about 150° C./hr.

12. A process in accordance with claim 7 wherein said cooling step comprises isothermally holding said sintered body at said holding temperature for at least 1 hr.

13. A process in accordance with claim 7 wherein said sintering step comprises sintering said shaped body at a temperature and in a vacuum sufficient to prevent the formation of a coating of said metallic binder on the surface of said sintered body.

14. A process in accordance with claim 13 further comprising the step of applying a hard refractory coating to said cooled sintered body.

15. A process in accordance with claim 7 wherein said sintering step comprises sintering said shaped body at a temperature and in a vacuum selected to promote the formation of a coating consisting essentially of said metallic binder on the surface of said sintered body.

16. A process in accordance with claim 15 further comprising the steps of removing said metallic binder coating from said surface of said sintered body; and applying a hard refractory coating to said cooled sintered body.

17. A fully dense ceramic-metal composite body exhibiting improved fracture toughness at its surface, said body comprising:

a core zone exhibiting an ASTM carbon porosity rating of about C02–C08; and a surface zone exhibiting an ASTM carbon porosity rating of about C00, said surface zone including an outer surface layer enriched in binder content to a depth of about 5–200 μm and to a degree sufficient to improve fracture toughness at said surface;

and said body consisting essentially of, overall:

a metallic binder selected from the group consisting of cobalt, nickel, and alloys thereof; wherein said metallic binder is present, in the case of cobalt, in an amount of about 2–15 weight percent, in the case of nickel, in an amount of about 2–12 weight percent, and, in the case of said alloy thereof, in an amount between about 2 and 12–15 weight percent, the maximum increasing with the ratio of cobalt to nickel in said alloy;

excess carbon in a form selected from the group consisting of elemental carbon and a precursor of carbon, wherein the total carbon present in said body overall is sufficient to result in said ASTM carbon porosity rating of C06 to C08 at said core zone, the weight ratio of said excess carbon to said binder being about 0.05:1 to 0.037:1;

optionally, 0 to less than 5.0 volume percent of B-1 carbides; and remainder tungsten carbide.

18. A ceramic-metal composite body in accordance with claim 17 wherein said metallic binder is cobalt in an amount of about 6 weight percent, and said total carbon present in said body overall is about 0.05–0.20 weight percent in excess of that required to produce excess carbon porosity.

19. A ceramic-metal composite body in accordance with claim 17 wherein said core zone exhibits an ASTM carbon porosity rating of about C06–C08.

20. A ceramic-metal composite body in accordance with claim 17 wherein said metallic binder is cobalt in an amount of about 6 weight percent and said excess-carbon to cobalt ratio in said body overall is 0.013:1 to 0.037:1.

21. A ceramic-metal composite body in accordance with claim 17 further comprising a coating consisting essentially of said metallic binder on the surface of said body.

22. A ceramic-metal composite body in accordance with claim 17 wherein no coating of said metallic binder is present on the surface of said body, said body further comprising a hard refractory coating on said surface of said body.

23. A ceramic-metal composite body in accordance with claim 22 wherein said hard refractory coating comprises one or more adherent layers of hard refractory materials selected from the group consisting of carbides and nitrides of titanium, tantalum, and hafnium, oxides of aluminum and zirconium, and combinations and solid solutions thereof.

24. A ceramic-metal composite body in accordance with claim 23 wherein said hard refractory coating comprises titanium carbide deposited directly on said surface of said body, and, optionally, further comprising one or more additional layers deposited on said titanium carbide, said additional layers being selected from the group consisting of alumina, and alumina/titanium nitride.

* * * * *